United States Patent [19]

Colodner et al.

[11] Patent Number: 4,669,548

[45] Date of Patent: Jun. 2, 1987

[54] EXHAUST GAS FIRE FIGHTING APPARATUS

[76] Inventors: Jesse L. Colodner, 322 Orangeburg Rd., Pearl River, N.Y. 10965; Edwin D. Ebner, 32 John St., New City, N.Y. 10956

[21] Appl. No.: 770,513

[22] Filed: Aug. 29, 1985

[51] Int. Cl.[4] ..... A62C 35/52; A62C 31/14; A62C 5/16

[52] U.S. Cl. ..... 169/12; 239/132.3; 169/70

[58] Field of Search ..... 169/11, 12, 24, 51, 169/52, 54, 62, 70, 91; 239/132.3, 132.5

[56] References Cited

U.S. PATENT DOCUMENTS 3,438,445 4/1969 MacCracken ..... 169/12 X
4,345,654 8/1982 Carr ..... 239/132.5 X

FOREIGN PATENT DOCUMENTS 325403 7/1903 France ..... 239/132.5
908890 10/1962 United Kingdom ..... 169/12

*Primary Examiner*—Jeffrey V. Nase

[57] ABSTRACT

This apparatus is designed for automotive vehicles, and enables the employment of a vehicle's engine exhaust to be used to put out fires. Primarily, it consists of a flexible hose with a nozzle or cone at one end for the exhaust gas of the engine to be directed onto a fire, and the other end of the hose is secured to a selector valve attached to the tail pipe portion of the engine's exhaust system, so as to divert the exhaust gas for fire fighting. The apparatus includes a water spray collar at the rear of the nozzle which is supplied from a water source to cool the nozzle, and the nozzle includes a handle for a user to hold it.

7 Claims, 3 Drawing Figures

EXHAUST GAS FIRE FIGHTING APPARATUS

BACKGROUND OF THE INVENTION

1. Field of the Invention

This invention relates to fire extinguishers, and more particularly, to an exhaust gas fire fighting apparatus.

2. Description of Prior Art

Automotive vehicles employ water, foam, slippery water, and other agents from tanks and bottles as fire extinguishers. The apparatus in accordance with the present invention will employ the exhaust gas from any internal combustion engine to effectively extinguish fires.

The principal object of this invention is to provide an exhaust gas fire fighting apparatus, which will be so designed, as to be coupled to any automotive vehicle's exhaust system, so as to utilize the carbon dioxide, carbon monoxide, and water vapor that basically comprises such exhaust gas, for fire fighting purposes.

Another object of this invention is to provide an exhaust gas fire fighting apparatus, which will be of such design, as to employ a flexible hose with a cone or nozzle to direct the exhaust gas onto a fire to quickly extinguish same.

Another object of this invention is to provide an exhaust gas fire fighting apparatus, which will be of such design, as to include selector valve means to divert the exhaust gas from an engine to the hose and cone or nozzle, or the hose and cone combination may be attached to any exhaust system directly.

A further object of this invention is to provide an exhaust gas fire fighting apparatus, which may or may not include water spray means for cooling the exhaust gas at the cone portion being handled by the user.

An even further object of this invention is to provide an exhaust gas fire fighting apparatus, which will include air cooling fin means on the end of the hose portion that will couple to the exhaust system.

SUMMARY OF THE INVENTION

Figure 1:
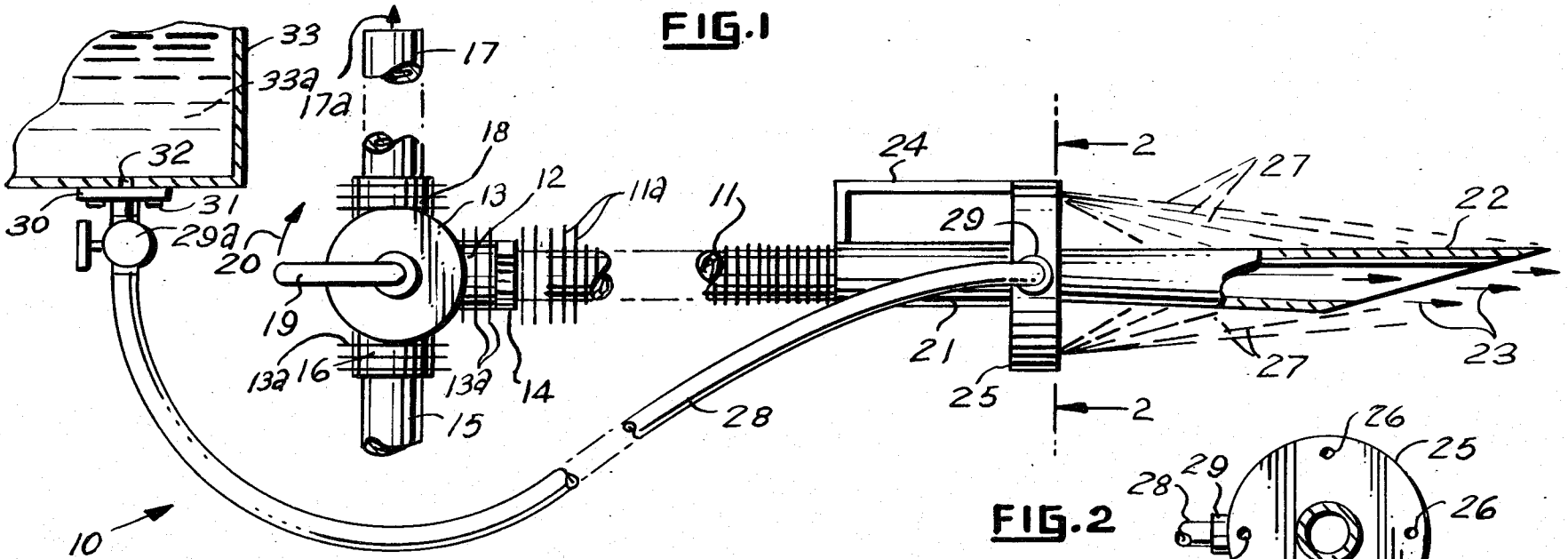
FIG. 1 is a fragmentary side view of the present invention, shown in elevation and partly in section.
Figure 2:
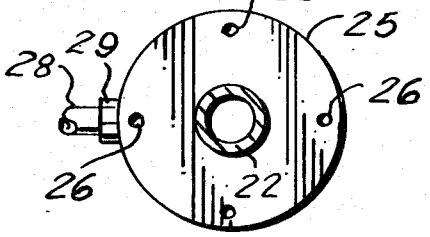
FIG. 2 is a cross-sectional view, taken along the line 2—2 of FIG. 1.

An exhaust gas fire fighting apparatus, comprising a flexible hose with a cone or nozzle secured to one end, which is directed onto a fire to be extinguished. The hose includes a coupling at its opposite end with air cooling fins and is attached to a selector valve with similar air cooling fins, which is operated by lever means to divert a vehicle's engine exhaust into the hose when it is needed to put out a fire, or the hose may be coupled to any exhaust system directly.

DETAILED DESCRIPTION

According to this invention, an apparatus 10 is shown to include a flexible hose 11 secured at one end to one outlet 12 of a selector valve 13 by a coupling 14, and the exhaust system tail pipe 15 of a vehicle, not shown, is secured in a suitable manner within an inlet 16 of valve 13. An extension exhaust pipe 17, which may or may not be used, is similarly secured in an aligned second outlet end 18 of valve 13, and the flow of the internal combustion engine exhaust is indicated by means of the arrow 17*a*. The coupling 14 of hose 11 includes a plurality of air cooling fins 11*a* for keeping coupling 14 cool when exhaust gas is traveling through, and selector valve 13 is also provided with similar air cooling fins 13*a* for its cooling. The exhaust flow control selection is effected by the rotation of the lever 19 of valve 13, as indicated by the arrow 20. When lever 19 is horizontal, the exhaust flow is only out of the extension pipe 17, if used. The opposite end of hose 11 is suitably secured within a sleeve 21, and sleeve 21 is fixedly secured and positioned to the rear of a hollow cone 22, from which the exhaust gas 23 travels onto a fire.

A handle 24 is suitably fixedly secured at one end, to the outer periphery of sleeve 21, and its opposite end is similarly secured to the rear face of a water spray collar 25, which is fixedly secured to the rear portion of cone 22. Spray collar 25 is provided with a plurality of radially and equally spaced openings 26, from which spray 27 is directed forward and on cone 22 for cooling purposes. A flexible second hose 28 is provided and is suitably secured at one end, in coupling 29 of spray collar 25, and the opposite end of hose 28 is secured to the outlet side of a water shut-off valve 29*a*, which is coupled to a fitting 30 fastened by fasteners 31 over the opening 32 in the bottom of a suitable tank 33 containing water 33*a* to be fed to the collar 25.

In operation, the engine of the vehicle is first turned on, and while running, lever 19 is rotated to its horizontal position which diverts the path of the exhaust gas from traveling into the atmosphere, and directs it through hose 11 and out of cone 22 onto a fire that is to be extinguished. The valve 29*a* is then turned to its on position, letting the water 33*a* flow into hose 28 and into the spray collar 25, where it sprays outward to cool cone 22, and to cool the fire. The handle 24 is then grasped by the operator and used to hold the cone 22 in the direction of the fire. When the fire is extinguished, the reverse of the abovementioned procedure is followed.

Figure 3:
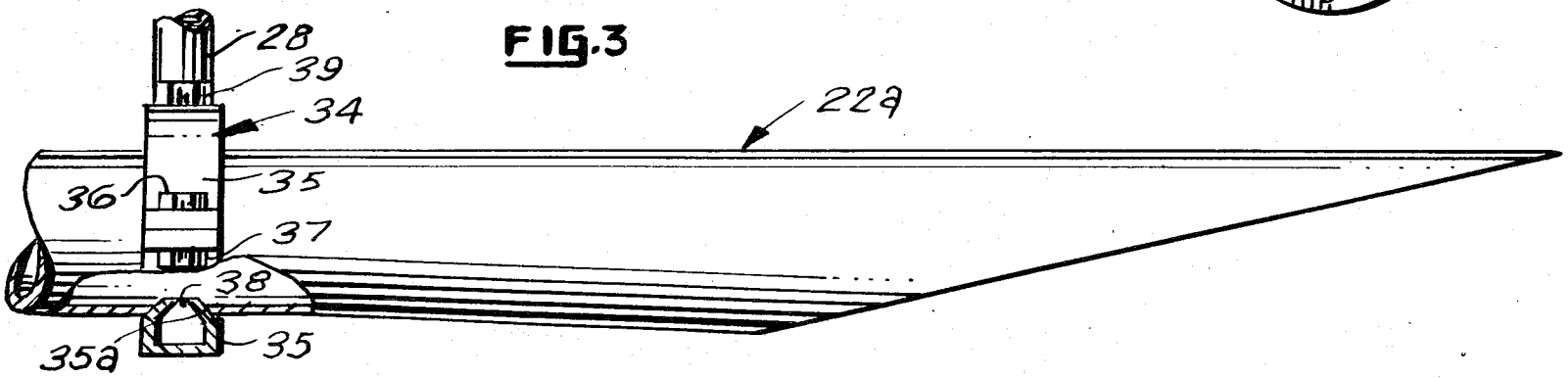
FIG. 3 is a fragmentary side view of a modified cone or nozzle, shown in elevation and partly in section.

Looking now at FIG. 3, a modified hollow cone 22*a* is provided with a spray collar 34, which is composed of two semi-circular halves 35 that are fastened to the outer periphery of the rear portion of cone 22*a*, by means of fasteners 36 and 37. A plurality of spray nozzles 38 are provided on the inner peripheries of halves 35, and they seat within the openings 35*a* through the outer periphery of the rear portion of cone 22*a*. The structure of 22*a* and collar 34, serve to provide an inwardly directed water spray into the path of the exhaust gas being directed onto a fire, and the water hose 28 is fastened to collar 34 by coupling 39.

In operation, cone 22*a* functions in the same manner as was described of cone 22, with the exception, that the spray of water is internally, rather than externally for cooling purposes.

While various changes may be made in the detailed construction, such details will be within the spirit and scope of the present invention, as defined by the appended claims.

What is claimed is:

1. An exhaust gas fire fighting apparatus, comprising, a flexible hose, a hollow cone secured to said hose for directing exhaust gas towards a fire, a selector valve secured to said hose diverting said exhaust gas into said hose, a sleeve secured to said hose, a water spray collar means secured to said cone for spraying water onto an outer surface of said cone, a second hose secured to said spray collar means, and a handle secured to said sleeve or spray collar means.

2. The combination as set forth in claim 1, wherein said flexible hose is provided with a coupling at one end that is removably received in a first outlet side of said selector valve and the opposite end of said hose is secured to one end of said cone, and a tail pipe of an exhaust system of an internal combustion engine is secured to an inlet side of said selector valve.

3. The combination as set forth in claim 2, wherein a plurality of air cooling fins are integrally attached to said first inlet side, a second outlet side, and said inlet side of said selector valve, for cooling said selector valve.

4. The combination as set forth in claim 3, wherein a plurality of similar cooling fins are integrally attached to said one end of said hose.

5. The combination as set forth in claim 4, wherein said sleeve is fixedly secured to the outer periphery of said opposite end of said hose and engages with said spray collar means, and said spray collar means is fixedly secured to the rear portion of said cone, and said handle is fixedly secured at one end of said sleeve and the opposite end of said handle is fixedly secured to said spray collar means, and said handle provides handle grip means for supporting said cone to aim said cone at a fire to direct said exhaust gas onto said fire.

6. The combination as set forth in claim 5, wherein a plurality of radially spaced openings in one face of said spray collar means enable water to spray forward onto the outer periphery of said cone and fire, cools said cone and fire.

7. The combination as set forth in claim 6, wherein said spray collar means is coupled at its outer periphery to one end of said second hose and the opposite end of said second hose is coupled to a water shut-off valve that is coupled to an outlet water opening in a tank.

* * * * *